US009669991B1

(12) United States Patent
Jorgensen

(10) Patent No.: US 9,669,991 B1
(45) Date of Patent: Jun. 6, 2017

(54) SECONDARY CONTAINMENT SYSTEM FOR DEF STORAGE CONTAINER

(71) Applicant: Roy W. Jorgensen, Evansville, IN (US)

(72) Inventor: Roy W. Jorgensen, Evansville, IN (US)

( * ) Notice: Subject to any disclaimer, the term of this patent is extended or adjusted under 35 U.S.C. 154(b) by 40 days.

(21) Appl. No.: 14/515,923

(22) Filed: Oct. 16, 2014

Related U.S. Application Data

(63) Continuation-in-part of application No. 12/804,661, filed on Jul. 27, 2010, now abandoned.

(51) Int. Cl.

| | |
|---|---|
| ***B65D 88/74*** | (2006.01) |
| ***B65D 85/00*** | (2006.01) |
| ***B65D 51/16*** | (2006.01) |
| ***B65D 81/38*** | (2006.01) |
| ***B65D 88/12*** | (2006.01) |

(52) U.S. Cl.
CPC ..... *B65D 85/70* (2013.01); *B65D 51/16* (2013.01); *B65D 81/38* (2013.01); *B65D 88/126* (2013.01); *B65D 88/74* (2013.01)

(58) Field of Classification Search
CPC ..... B61D 5/04; B65D 51/16; B65D 81/38; B65D 81/3825; B65D 81/383; B65D 85/70; B65D 88/126; B65D 88/74; B65D 88/748
USPC ..... 220/23.87, 560.1, 560.12, 567.1, 567.2, 220/592.01, 592.02, 592.2, 592.23, 220/592.26, 592.28, 746, 747, 749, 750, 220/796, 797, 913
See application file for complete search history.

(56) References Cited

U.S. PATENT DOCUMENTS

| | | | | | |
|---|---|---|---|---|---|
| 2,551,435 | A * | 5/1951 | Grogan | 137/312 | |
| 4,162,020 | A * | 7/1979 | Kirkland | 220/565 | |
| 4,895,272 | A * | 1/1990 | De Benedittis et al. | 220/745 | |
| 5,033,638 | A * | 7/1991 | Cruver et al. | 220/571 | |
| 5,287,986 | A * | 2/1994 | Frost | 220/565 | |
| 5,299,709 | A * | 4/1994 | Beerbower et al. | 137/356 | |
| 5,555,999 | A * | 9/1996 | Wilcox | 220/565 | |
| 5,582,310 | A * | 12/1996 | Del Zotto | 220/4.12 | |
| 5,702,026 | A * | 12/1997 | Lindquist | B65D 90/36 | 220/565 |
| 5,881,760 | A * | 3/1999 | Del Zotto | 137/264 | |
| 5,884,709 | A * | 3/1999 | Evans et al. | 169/46 | |
| 5,893,479 | A * | 4/1999 | Berberat | 220/567 | |
| 6,422,413 | B1 * | 7/2002 | Hall et al. | 220/567.2 | |
| 6,686,003 | B2 * | 2/2004 | Legare | 428/34.4 | |
| 2007/0267420 | A1 * | 11/2007 | Brockel et al. | 220/592.2 | |
| 2008/0257894 | A1 * | 10/2008 | Podd et al. | 220/565 | |
| 2011/0024432 | A1 * | 2/2011 | Jorgensen | 220/592.2 | |

* cited by examiner

*Primary Examiner* — James N Smalley
(74) *Attorney, Agent, or Firm* — Gary K Price

(57) ABSTRACT

A secondary containment system used to transport and store a tank containing fluid. The secondary containment system having a containment body comprising an end wall, a back wall, two side walls, a bottom, and a top, wherein the walls are integral to the bottom, and wherein the top can be displaced from the containment body. The containment body is constructed of a three-layer configuration comprising an inner layer, an outer layer, and a central layer sandwiched therebetween. The inner layer defines a chamber in which the tank containing the fluid is stored. The chamber is sized and shaped so that the tank is positioned in the chamber and defines a void between walls of the inner layer and the tank.

19 Claims, 3 Drawing Sheets

24
24A
21
105A
105B
105
104B
104
104A
100

SECONDARY CONTAINMENT SYSTEM FOR DEF STORAGE CONTAINER

CROSS REFERENCES TO RELATED APPLICATIONS

U.S. Provisional Application for Patent No. 61/271,919, filed Jul. 28, 2009, with title "Pump Island DEF Dispenser" which is hereby incorporated by reference. Applicant claims the benefit of co-pending U.S. patent application Ser. No. 12/804,661 filed Jul. 27, 2010 which claims the benefit of U.S. Provisional Application No. 61/271,919 filed on Jul. 28, 2009 with title "Pump Island DEF Dispenser."

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

This invention relates generally to a transport and storage container for liquids and more particularly to a secondary containment for transporting and storing Diesel Exhaust Fluid (DEF).

2. Brief Description of Prior Art

In 1990, Congress passed and President George H.W. Bush signed amendments to the Clean Air Act that directed the U.S. Environmental Protection Agency (EPA) to regulate air pollutants from a variety of industrial and commercial sources including motor vehicles.

Among the air pollutants EPA regulates under the authority of the Clean Air Act are particulate matter (PM) and Nitrogen Oxides (NOx) by products of diesel exhausts that are precursors to smog. PM has been linked to higher incidences of childhood asthma, among other health hazards. The more sulfur motor fuel contains, the more PM it produces when burned. NOx is produced during the process of high-temperature combustion such as is present in a motor vehicle engine, and can react with sunlight along with volatile organic compounds to form smog.

Exhaust treatment systems work hand in hand with reductions in the amount of sulfur in diesel fuel to reduce PM and NOx. In order to meet EPA regulations on limiting emissions of PM and NOx from their vehicle exhaust system many of the engine manufactures have or will adopt a pre-exhaust treatment system such as Selective Catalytic Reduction (SCR). SCR engines require a steady flow of Diesel Exhaust Fluid (DEF)—comprised of a solution of urea and water- to convert engine emissions into harmless levels of nitrogen and water vapor. As such, DEF will be required in most diesel vehicles in order to replenish the clean exhaust systems using SCR.

The term "diesel exhaust fluid" (DEF) only recently entered the United States fleet industry with the advent of a particular type of clean exhaust system, SCR. Because these clean exhaust systems are sensitive and the material must remain pure, quality is a key concern for anyone marketing or handling DEF. In this regard, distribution network certification systems are being established to meet the need for quality DEF through truck stops and retail outlets and to accommodate a wide variety of dispensing options.

DEF is not an additive, and is not mixed with diesel fuel. In a vehicle outfitted with an SCR system, DEF has a separate on-board tank (6-10 gallons on light-duty vehicles; 10-30 gallons on heavy-duty vehicles). From its storage tank, DEF is pumped through a filter and injector and then, into the exhaust system. In the after treatment system, the heat from the exhaust hydrolyzes the urea into two components: Anhydrous Ammonia and CO2. The gas mixture of ammonia and NOx passes across the catalyst and reduces them to elemental nitrogen and water, harmless since air is composed of 78% elemental nitrogen. The additional CO2 emitted due to urea decomposition is offset by enhanced fuel economy. A gallon of diesel emits ten times more CO2 than a gallon of DEF.

DEF is distributed in the fleet marketplace through truck stops along interstate routes and through truck terminals. Fuel oil distributors generally vend DEF in mini-bulk storage containers that are delivered to a fuel island and hooked to a dispensing pump for retail at service locations.

As stated, the integrity of DEF through the supply chain is critical. Purity and concentration must be maintained through the dispensing equipment, storage and handling, including any small packaging for DEF. Supply-chain partners must undergo a rigorous process to handle the fluid properly. It can therefore be appreciated that there exists a continuing need for a transport and storage system for storing DEF in order to ensure proper DEF dispensing operability especially where extreme temperature conditions exist, and handling DEF for retail installation. It is also imperative that the transport and storage system maintain the purity and concentration to satisfy EPA standards. The present invention meets this need.

SUMMARY OF THE INVENTION

A secondary containment system used as a transport and storage container for storing a tank containing DEF. The secondary containment system is comprised of a three-layer configuration comprising an inner layer, an outer layer, and a central layer sandwiched between the inner and outer layers. The inner and outer layers are constructed of a first material, preferably a UV protected polyethylene; and, the central layer is constructed of a second material, preferably a 2"—2 lb. density polyurethane insulation material having an R17 value.

The inner layer defines a chamber in which the tank containing the DEF is stored. The chamber is sized and shaped so that the DEF tank is positioned in the chamber and defines a void between the side walls of the inner layer and the DEF storage tank, the void is defined for receiving a heating unit in order to prevent the DEF, when storing, from freezing in extreme cold temperatures.

The inner, outer and central layers that define the secondary containment system have the primary task of maintaining the temperature of the DEF storage tank during transport and storage. The secondary containment system including the central layer assists in insulating all sides of the DEF tank from varying temperature conditions. In addition, the three-layer containment system protects the DEF storage tank during transport and storage.

DESCRIPTION OF THE PREFERRED EMBODIMENT

The apparatus of the present invention is directed to a transport and storage containment system for storing and handling diesel exhaust fluid (DEF). More particularly, the present invention discloses a secondary containment system that stores and protects the tank containing DEF. In the preferred embodiment, the secondary containment system with the stored DEF is delivered to a fuel island and hooked up to a dispensing pump for retail through truck stops alongside interstate routes, through truck terminals, and other retail outlets. In the broadest context, the secondary containment system for DEF storage container as disclosed consists of components configured and correlated with respect to each other so as to obtain the desired objective.

Figure 1:
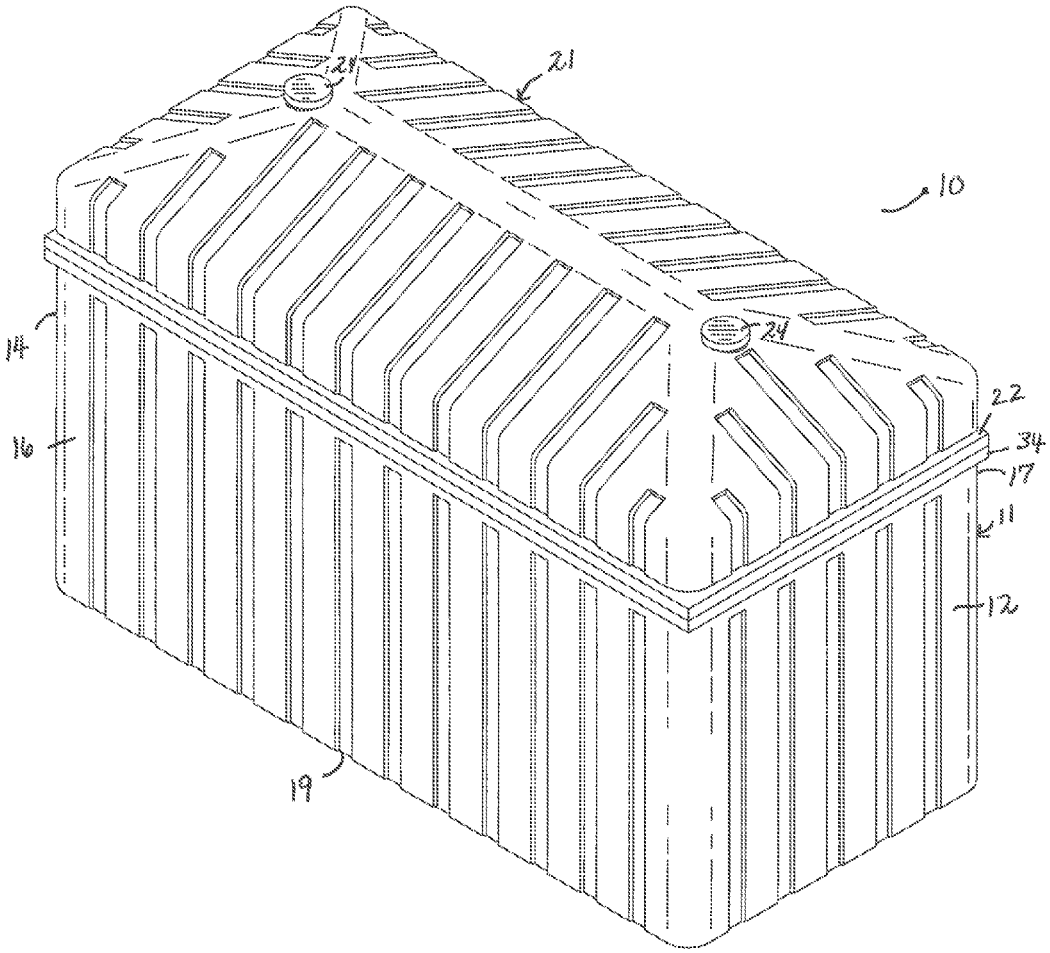
FIG. 1 is a perspective view of a preferred embodiment of the present invention, a secondary containment system for a DEF storage container.
Figure 2:
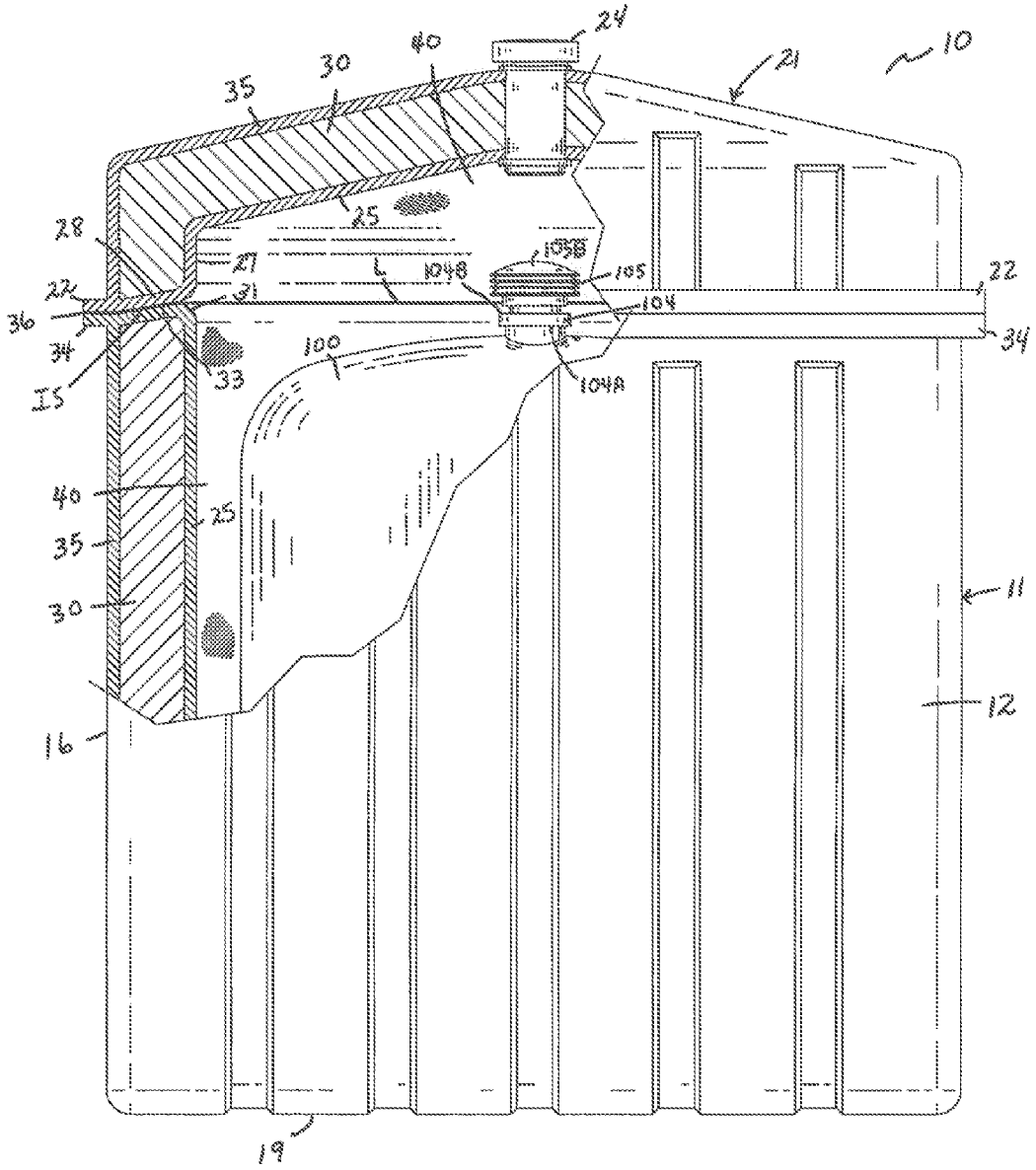
FIG. 2 is an end sectional view of the secondary containment system of FIG. 1.
Figure 3:
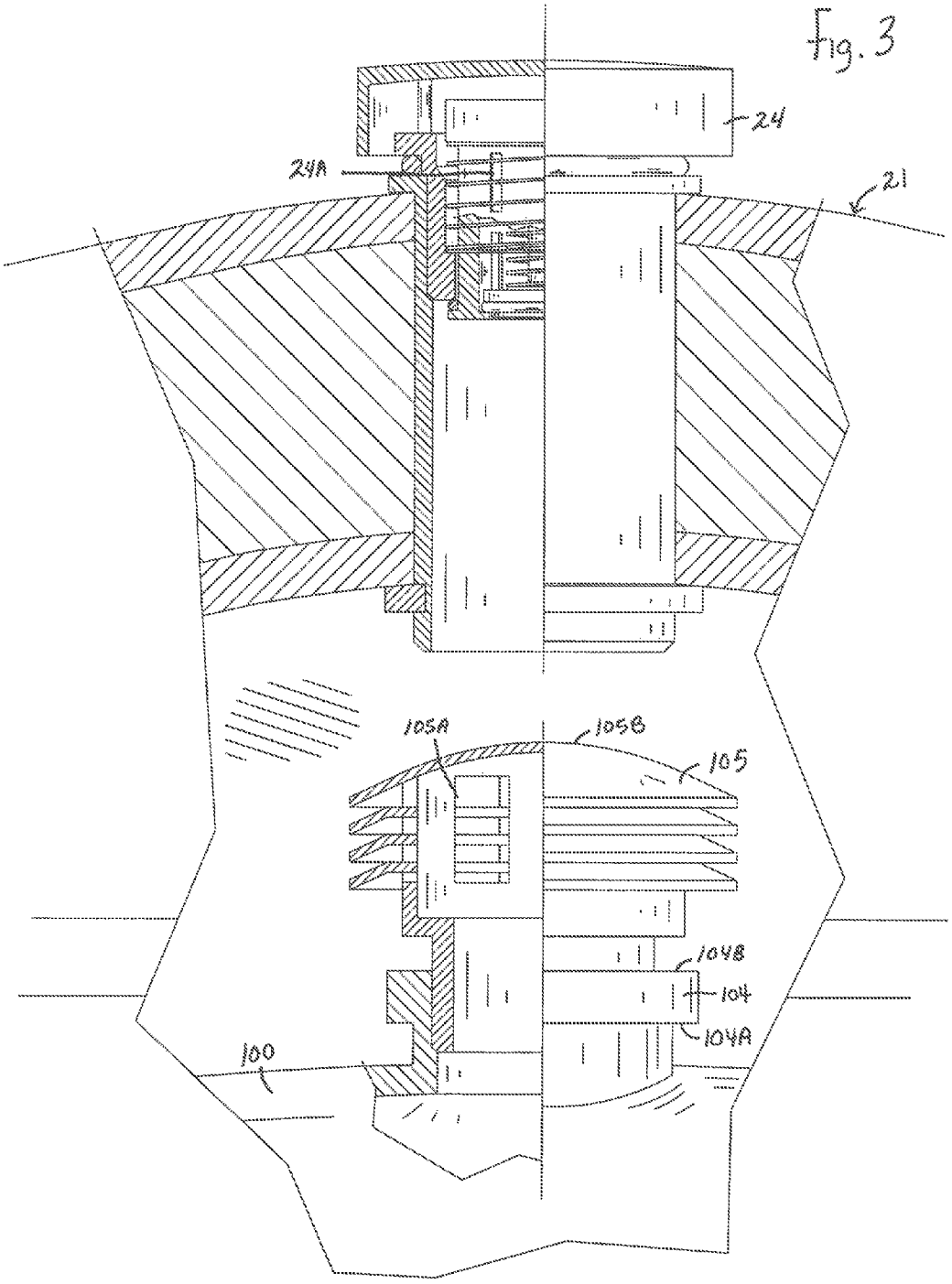
FIG. 3 is an exploded end view of the secondary containment system of FIG. 2 illustrating the system's primary and secondary vents.

Referring to FIGS. 1-3, the present invention designated as numeral 10, discloses a secondary containment system which is used as a transport and storage container for storing a tank 100 containing a fluid, such as DEF. The container 10 of the present invention includes a base portion 11 that includes an end wall 12, a back wall 14, and two side walls, 16, 17, as well as a bottom 19. The container 10 further includes a top 21. The walls 12, 14, 16 and 17 are integral to the bottom 19. The top 21 can be displaced, and includes a lower most edge 22, that as will be described, matches with an upper most edge 34 of the base portion 11.

The end wall 12, the back wall 14, the side walls 16, 17, as well as the bottom 19 and the top 21 are comprised of a three-layer configuration comprising an inner layer 25, a central layer 30, and an outer layer 35 (see FIG. 2), the central layer 30 being sandwiched between the inner and outer layers 25, 35. The inner layer 25 and the central layer 30 are wholly inside the outer layer 35. The manufacturing of the inner and outer layers 25, 35 is suitably through an injection moulding process.

As shown in FIG. 2, the inner layer 25 defines a chamber 40 in which the tank 100 containing the fluid is stored. The chamber 40 is sized and shaped so that the tank 100 is positioned in the chamber 40 and defines a void 42 between the walls 12, 14, 16, 17 of the inner layer 25 and the DEF storage tank 100. As will be understood, the void 42 is defined for receiving a heating unit (not shown) in order to prevent the fluid, when storing, from freezing in extreme cold temperatures.

As illustrated, the tank 100 includes a top cap 104 that defines a lower most surface 104A (see FIG. 2). The top cap 104 further includes a primary tank vent 105 that is in fluid communication with the contents of the tank 100 and the void 42. The primary tank vent 105 has a top surface 105B that is positioned higher than the lower most edge 22.

Further, as illustrated in the drawings, the container 10 further includes at least one secondary tank vent 24 that is in fluid communication with the void 42.

The at least one secondary tank vent 24 and primary tank vent 105 include apertures 24A, 105A, respectively, that allows air and pressure to easily flow and equalize with no restrictions from inside the container 10. The venting 24 both pulling air from the void 42, and pulling fresh air from the outside of the system 10 into the void 42.

In the alternative, the primary tank vent 105 is a pressure and vacuum vent and has a climate dampening effect. In this regard, the vent 105 stays closed unless pressure drops inside the container 10 a pre-determined amount, or pressure increases a pre-determined amount, then it immediately closes. As such, the vent 105 stays closed the majority of the time, and rarely opens only for an instant.

The pressure vacuum vent, along with the insulation factor as will be discussed, permits a very slow atmospheric change in the container 10. This very slow atmospheric change in the container 10 is important during cold weather when heaters are used to keep the fluid in the tank 100 warm, and also equally effective during very warm or hot outside temperatures that heat up the outside of the container 10.

As further illustrated, each of the side walls 16, 17 define an upper most end 31 that merges with a horizontal portion 33 that merges with the upper most edge 34. The inner layer 25 of the top 21 similarly defines a vertical portion 27 that merges with a horizontal portion 28 that merges with the lower most edge 22. In application, the horizontal portion 33 mates with the horizontal portion 28 such that the lower most edge 22 rests on the upper most edge 34. In the preferred embodiment, a seal 36 is disposed between the horizontal portions 28, 33. As shown in FIG. 2, the horizontal potions 28, 33 define an angled or inclined surface "IS" with seal 36 therebetween. It is important that a top surface 104B of the top cap 104 is positioned below the upper most end 31, as illustrated with line L in FIG. 2, such that the tank 100 is contained within the base portion 11.

The inner layer 25 and outer layer 35 is preferably constructed of a UV protected polyethylene. The central layer 30 is preferably constructed of a 2 $lb/ft^3$ density polyurethane insulation material having an R-value of 17 ("R17"). To clarify, the end wall 12, the back wall 14, the side wall 16, 17, as well as the bottom 19 and the top 21 are all comprised of the three-layer configuration as described.

The layers 25, 30 and 35 that define the container 10 have the primary task of maintaining the temperature of the DEF storage tank 100 during transport and storage. Unlike prior art DEF storage tanks, the secondary containment system 10 includes the central layer 30 to assist in insulating all sides of the DEF tank 100 from varying temperature conditions. While it is known to install a heating unit (not shown) adjacent the DEF storage tank in order to avoid freezing, the applicant has found the use of the R17 insulated system of the present invention results in less energy used for maintaining and heating the DEF temperature resulting in significant cost savings. In addition, the layers 25, 30 and 35 provide layers of protecting the storage tank 100 during transport and storage.

The secondary containment system according to the invention is used as follows:

Once the top 21 of the secondary containment system 10 is lifted off the container 10, the storage tank 100 containing the DEF is placed within the chamber 40 of the inner layer 25.

After the tank 100 is positioned in the chamber 40, the top 21 is closed.

The secondary containment system 10 having the tank 100 containing the DEF is then transported and delivered to a fuel island to be hooked to a dispensing pump.

The secondary containment system 10 protects against any type of mechanical action from outside by use of the defined three-layer system, and the extremely durable materials used in construction. One or more blows struck as a test against the outer layer 35 were withstood without damage to the storage tank 100 disposed in the chamber 40.

The system 10 is further effective in preventing the DEF from freezing during short periods of time in extreme cold conditions, and without an auxiliary heating unit. The R17 insulated system has withstood and protected the DEF in freezing temperatures for at least three (3) days without the use of a heating unit, and continued during this time to maintain its dispensing operability. Thus, when using the present invention, it is possible to protect the DEF from freezing temperatures should for example, the system's heating source malfunction.

The secondary containment system 10 is also safe in very warm temperatures. Again, the R17 insulated system protects the DEF in order to maintain its dispensing operability.

The secondary containment system 10 is designed to grow with the user's business, and preferably has a 400 to 1000 gallon usable storage capacity.

Although the above description contains many specificities, these should not be construed as limiting the scope of the invention but is merely providing illustrations of some of the presently preferred embodiments of this invention. As such, it is to be understood that the present invention is not limited to the embodiments described above, but encompasses any and all embodiments within the scope of the claims.

I claim:

1. A secondary containment system comprising:

a containment body comprising an end wall, a back wall, first and second side walls, and a bottom, wherein the end wall, the back wall and the side walls are integral to the bottom, and a top that can be displaced from the containment body, said top includes a lower most edge, a storage tank containing a fluid, said storage tank having a top cap, said top cap defining a lower most surface and a top surface, wherein the end wall, the back wall, the side walls, the bottom and the top are comprised of a three-layer configuration comprising an inner layer, a central layer and an outer layer, the central layer being sandwiched between the inner and outer layers, and wherein the inner layer and the central layer are wholly inside the outer layer, wherein the inner layer defines a chamber, the storage tank is positioned in the chamber, said chamber further defines a void between walls on the inner layer and walls on the storage tank, said void sized for receiving a heating unit, said containment body further including at least one secondary tank vent having a top portion, a body portion and a lower most end, the body portion including an outer opening, a primary tank vent including a vent top that defines an inner opening, wherein said inner layer of said top includes first and second horizontal portions that merge with said lower most edge, and wherein said first side wall defines a first upper most end, and wherein said second side wall defines a second upper most end, and wherein said top surface below said first and second upper most ends, and wherein said primary tank vent has a lower most end that is in abutting communications with said top surface and wherein said at least one secondary vent extends through said inner and outer layers of said top such that said at least one secondary tank vent is in fluid communication with elements outside the system and the lower most end of said secondary tank vent is in fluid communication with said void, and said inner opening is disposed inside the containment body and in fluid communication with said void and said storage tank's fluid, and wherein at least a portion of said outer opening is positioned above an outer most surface of said outer layer of said top, and wherein the inner and outer layers are constructed of a first material, and the central layer is constructed of a second material preferably an insulation material.

2. The containment system as recited in claim 1, wherein said first upper most end merges with a first upper inclined portion that defines a first inclined surface that merges with an upper most edge of said containment body, and wherein said second upper most end merges with a second upper inclined portion that defines a second inclined surface that merges with said upper most edge.

3. The containment system as recited in claim 2, wherein said upper most edge matches said lower most edge.

4. The containment system as recited in claim 3, wherein the inner layer of said top includes first and second inclined ends, wherein said first inclined end mates with the first upper inclined portion and the second inclined end mates with the second inclined portion with a seal therebetween.

5. The containment system as recited in claim 1, wherein said primary tank vent and said secondary tank vent are air vents.

6. The containment system as recited in claim 1, wherein said primary tank vent is a closed vent that opens when a pressure changes within the containment body a pre-determined amount.

7. A secondary containment system comprising:

a containment body having a base and a top, said base comprising an end wall, a back wall, first and second side walls, a bottom, wherein the end wall, the back wall and the first and second side walls are integral to the bottom, and wherein the top can be displaced from the base, said top further includes a lower most edge, and wherein the containment body defines an inner layer integral to an outer layer, an inter-space between the inner and outer layers is defined by a central layer;

wherein the inner layer of said base defines a chamber sized for receiving a storage tank and, defines a void between walls of the inner layer and walls of the storage tank, wherein said void is sized for receiving a heating unit;

wherein said containment body further includes at least one body vent that defines a body vent aperture, wherein said body vent aperture is disposed above an outer most surface of said top's outer layer, and wherein said storage tank includes a top cap having a top surface, and a cap vent that defines a cap vent aperture; and, wherein said first side wall has an upper most end that defines a first surface and said second side wall has an upper most end that defines a second surface, and said top includes a first end that rests on said first surface and a second end that rests on said second surface, and wherein said body vent passes through said top's inner and outer layers such that said at least one body vent is in fluid communication with elements outside the system and said void, and said cap vent aperture is disposed inside the containment body and in fluid communication with said void and said storage tank's fluid.

8. The containment system as recited in claim 7, further including a first seal disposed between said first surface and said first end, and a second seal disposed between said second surface and said second end.

9. The containment system as recited in claim 8, wherein said first and second surfaces merge with an upper most edge of said base.

10. The containment system as recited in claim 9, wherein said first and second ends merge with said lower most edge.

11. The containment system as recited in claim 10, wherein said first and second surfaces are angled surfaces, and said first and second ends are angled ends, and wherein said upper most edge matches said lower most edge.

12. The containment system as recited in claim 11, wherein said first angled surface defines a first upper most end, and said second angled surface defines a second upper most end, and wherein said top surface of said top cap is positioned below said first and second upper most ends.

13. A secondary containment system comprising:

an enclosure that includes a base having first and second side walls, said enclosure including a top that can be displaced, said top defines a lower most edge, said lower most edge matches an upper most edge of said base, said enclosure further defines an inner wall, an outer wall, and a center disposed between said inner and outer walls, each of said first and second side walls defining an upper most end, said inner wall defines a chamber sized and shaped to receive a storage tank, and wherein said enclosure further includes at least one secondary vent that includes a secondary aperture disposed in a body portion of said at least one secondary vent, and wherein said at least one secondary vent extends through said top's inner and outer walls such that said at least one secondary vent is in fluid communication with elements outside the enclosure and said chamber, and wherein said secondary vent is at least partially positioned above an upper most surface of said top, a primary vent that defines a primary vent aperture, and wherein said primary vent aperture is disposed inside the enclosure and in fluid communication with said chamber and said storage tank's fluid, and an upper most end of said primary vent is positioned above said lower most edge, and wherein said inner and outer walls are constructed of a first material, and said center is disposed of a second material.

14. The containment system as recited in claim 13, wherein said chamber further defines a void between the inner walls and the stored tank.

15. The containment system as recited in claim 14, wherein said first side wall defines a first angled surface that merges with said first upper most end and said upper most edge, and said second side wall defines a second angled surface that merges with said second upper most end and said upper most edge.

16. The containment system as recited in claim 15, wherein the inner wall of said top defines a first angled end that rests on said first angled surface and a second angled end that rests on said second angled surface.

17. The containment system as recited in claim 16, further including a first seal disposed between said first angled surface and said first angled end, and a second seal disposed between said second angled surface and said second angled end.

18. The containment system as recited in claim 17, wherein said upper most end of said primary vent is positioned higher than said upper most ends of said first and second side walls.

19. The containment system as recited in claim 13, wherein said primary vent is a closed vent that opens when a pressure changes a pre-determined amount within the enclosure.

* * * * *